US005530991A

United States Patent [19]

deNormand et al.

[11] Patent Number: 5,530,991

[45] Date of Patent: Jul. 2, 1996

[54] BLOCK AND TACKLE WINDOW BALANCE

[75] Inventors: Richard S. deNormand, Rochester; James A. Martini, Honeoye Falls; Norman R. Westfall, Rochester, all of N.Y.

[73] Assignee: Caldwell Manufacturing Company, Rochester, N.Y.

[21] Appl. No.: 184,663

[22] Filed: Jan. 21, 1994

[51] Int. Cl.[6] ..... E05F 5/08

[52] U.S. Cl. ..... 16/198

[58] Field of Search ..... 16/194, 196, 197, 16/198, 199, 200, DIG. 16; 49/445, 446

[56] References Cited

U.S. PATENT DOCUMENTS

| | | | |
|---|---|---|---|
| 395,165 | 12/1888 | Morgan . | |
| 429,941 | 6/1890 | McArthur . | |
| 443,391 | 12/1890 | Cashner . | |
| 598,574 | 2/1898 | Pischke . | |
| 1,243,107 | 10/1917 | Richardson . | |
| 1,723,326 | 8/1929 | Bothe . | |
| 2,260,013 | 10/1941 | Elvers . | |
| 3,064,306 | 11/1962 | Beasley, Jr. et al. . | |
| 3,358,403 | 12/1967 | Dismore | 16/197 |
| 3,440,683 | 4/1969 | Wood | 16/197 |
| 3,609,796 | 10/1971 | Skolnik . | |
| 4,642,845 | 2/1987 | Marshik | 16/194 |
| 4,672,713 | 6/1987 | Newton et al. . | |
| 4,689,850 | 9/1987 | Flight | 16/197 |
| 4,697,304 | 10/1987 | Overgard | 16/198 |
| 4,811,455 | 3/1989 | Ost et al. | 16/197 |

*Primary Examiner*—Maurina T. Rachuba
*Assistant Examiner*—Kenneth J. Hansen
*Attorney, Agent, or Firm*—Eugene Stephens & Associates

[57] ABSTRACT

A block and tackle window balance includes an extension spring and two blocks of pulleys mounted within a rigid channel. A spring coupling connects a free end of the extension spring to the first block of pulleys. The pulleys of the first block are sized in width to center the spring coupling and the free end of the extension spring within the channel. The second block of pulleys are mounted on an axle that is received in slots formed in the channel. A center portion of the axle guides a pulley cord through the second block for exiting the balance.

5 Claims, 1 Drawing Sheet

BLOCK AND TACKLE WINDOW BALANCE

FIELD OF INVENTION

The invention relates to the field of block and tackle window balances for offsetting the weight of a window sash throughout a range of travel within a window frame.

BACKGROUND

Block and tackle window balances combine a system of pulleys with an extension spring to convert high spring tension applied over a short working distance to a lower spring tension applied over a longer working distance. The extension spring and pulley system are arranged within a rigid channel, with the extension spring anchored at one end and the pulley system anchored at the other end. The balance channel is attached to a window sash or a window frame; and a cord, which is reeved through the pulley system, is attached to the other of the window sash or frame. The extension spring and pulley system are sized so that a desired lifting force is applied to the window sash throughout the entire range of sash travel within the window frame.

Special couplers are used to connect a free end of the extension spring to the pulley system. For example, commonly assigned U.S. Pat. No. 4,672,713 to Newton et al. discloses a tube-shaped coupler projecting from a movable block of a pulley system. The coupler has a recess that receives an indented coil at the free end of an extension spring to provide an interlock between the coupler and the extension spring.

Another commonly assigned patent, namely, U.S. Pat. No. 4,689,850 to Flight, discloses a coupler having a similar tube-shaped section for engaging an extension spring. However, Flight's coupler also has a plate-shaped section for mounting an axle of a movable pulley block and a hook formed at one end of the plate-shaped section for attaching one end of a pulley cord. The axle is formed by a pair of interlocking rivets having journals for supporting respective pulleys and heads for trapping the respective pulleys against opposite sides of the plate-shaped section.

Couplers having tube and plate sections are difficult to make to required accuracy and add cost to window balances. Accordingly, the tube sections have been replaced by extending the plate sections to include triangular heads with two abutment surfaces for engaging tapered ends of the extension springs. Coils on the free end of extension springs are crimped tightly around a neck portion of the entirely plate-shaped couplers to interlock with the abutment surfaces.

Although the plate-shaped couplers are easy to manufacture at low cost, difficulties persist with maintaining proper alignment of the extension springs within the balance channel. Small inaccuracies in the crimping of the extension springs to the plate-shaped couplers can cause the extension springs to scrub against the walls of the channel, creating noise and additional friction that can cause the cords to fail from extra strain. Persistent scrubbing can also cause a failure of the channel walls.

Prior block and tackle balances, such as the balance system disclosed in the coassigned patent to Flight, include relatively expensive arrays of hardware for anchoring fixed pulley blocks to channel ends. The fixed pulley blocks include two sets of pulleys having axles mounted in tandem along support plates. A series of bends are made in the support plates to form hooks for attaching the support plates to the channel ends.

SUMMARY OF INVENTION

Our invention overcomes problems with prior block and tackle window balances by providing better ways of centering extension springs and mounting pulley blocks within balance channels. Together, these improvements reduce noise, wear, and cost.

One example of our new balance system includes an extension spring and first and second blocks of pulleys mounted within a rigid channel. One end of the extension spring and the second block of pulleys are anchored at opposite ends of the channel. A spring couple attaches a free end of the extension spring to the first block of pulleys.

The free end of the extension spring is loosely crimped around a rounded head of the spring coupler to permit angular movement between the spring coupler and the extension spring. An axle of the first block of pulleys includes two axle halves attached to opposite sides of the spring coupler for centering the spring coupler between two pulleys. The free end of the extension spring is centered within the channel by sizing the pulleys of the first block to fill a space between opposite sides of the channel.

The second block of pulleys is mounted on an axle that is received within slots formed in the Opposite sides of channel for anchoring the second block of pulleys to one end of the channel. Two heads are formed at opposite ends of the second axle for supporting the opposite sides of the channel at a predetermined spacing. A center portion of the second axle guides a pulley cord between two pulleys mounted on the second axle. The center portion includes shoulders for separating the pulleys mounted on the second axle and an annular groove for guiding the cord. Alternatively, a third pulley could be mounted on the center portion for reversing a direction at which the cord emerges from the balance.

DRAWINGS

DETAILED DESCRIPTION

Figures 1, 2, 3, 4, 5, 6, 7:
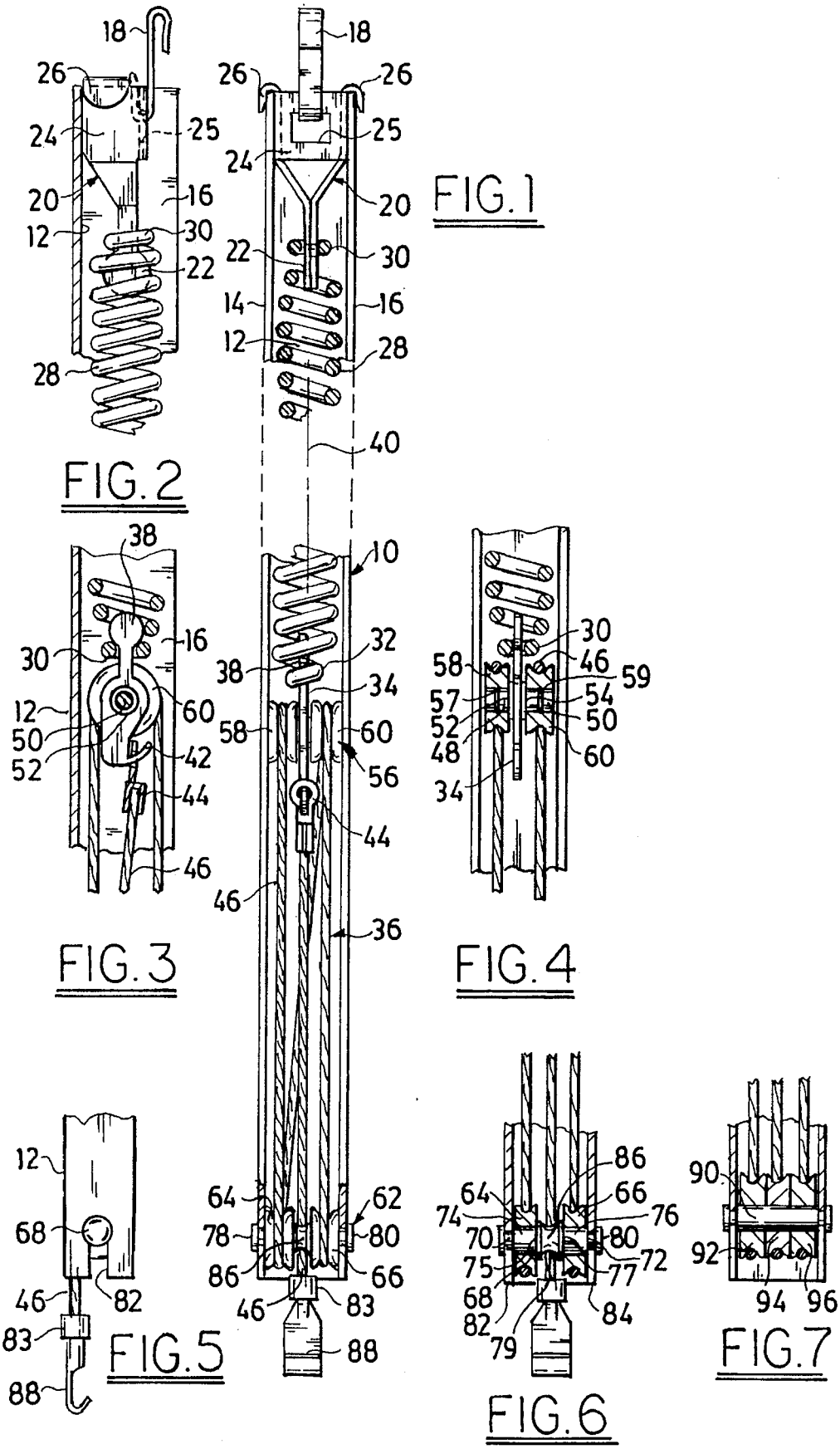
FIG. 1 is a fragmentary plan view of our new block and tackle window balance including an extension spring and two pulley blocks
FIG. 2 is a cross-sectional side elevational view of the same portion of the balance illustrated in FIG. 1.
FIG. 3 is a fragmentary cutaway side elevational view of a spring coupling joining the extension spring and a first of the two pulley blocks.
FIG. 4 is a cross-sectional plan view of the same portion of the balance illustrated in FIG. 3.
FIG. 5 is a fragmentary side elevational view at one end of the balance showing a slot used to mount a second of the two pulleys.
FIG. 6 is a cross-sectional plan view of the same portion of the balance illustrated in FIG. 5.
FIG. 7 is a cross-sectional plan view of an alternative pulley block including three pulleys.

One example of our new block and tackle window balance is illustrated in the drawing figures. The balance includes a rigid U-shaped channel 10 having a bottom 12 and two sides 14 and 16. A double-hook hanger 18 attached to an anchor 20 suspends the balance from a window jamb liner (not shown).

The anchor 20 has a rounded head 22 and a body 24 with two ears 26 that are wrapped around the two sides 14 and 16 of the channel. An opening 25 in the body 24 receives one end of the double-hook hanger 18. An extension spring 28 has a fixed end 30 with conically tapered coils that are crimped around the head 22 to attach the extension spring 28 to the anchor 20. The head 22 centers the fixed end 30 of the extension spring between the two sides 14 and 16 of the channel. Also, the head 22 is centered slightly above the ears 26 so that tension of the extension spring 28 tips the fixed end 30 against the bottom 12 of the channel.

A plate-shaped spring coupler 34 attaches a free end 32 of the extension spring 28 to a block and tackle assembly 36. A round head 38 at one of two ends of the spring coupler 34 loosely engages conically tapered coils at the free end 32 of the extension spring similar to a ball-and-socket joint. The tapered coils at the free end 32 are centered with respect to a central axis 40 of the extension spring. A hook 42 is formed at the other end of the spring coupler 34 for receiving an eyelet 44 attached to a pulley cord 46.

Two interlocking axle halves 48 and 50 are press fitted into engagement with each other through a hole in the spring coupler 34. Shoulders 52 and 54 support the axle halves 48 and 50 in positions that project equidistantly from the spring coupler 34 at right angles to the central axis 40 of the spring.

A first pulley block 56 includes pulleys 58 and 60 that are mounted for rotation about the axle halves 48 and 50. The two pulleys 58 and 60 are sized in width to fill a space between the two sides 14 and 16 of the channel and are made from resin bearing material such as acetal to reduce friction between the pulleys 58 and 60 and the channel sides 14 and 16. Annular detents 57 and 59 formed in the pulley bearings provide snap-fit engagements with complementary grooves in the axle halves 48 and 50 to secure the pulleys 58 and 60 to the axle halves prior to fitting the first pulley block 56 within the channel 10. The two pulleys 58 and 60 are also sized equally in width to center the spring coupler 34 and, with it, the free end 32 of the extension spring between the two channel sides 14 and 16.

A second pulley block 62 includes pulleys 64 and 66 mounted on an integral axle 68. Narrowed neck portions 70 and 72 between journals 74 and 76 and heads 78 and 80 of the axle 68 are received in longitudinal slots 82 and 84 formed in the channel sides 14 and 16. The journals 74 and 76 and the heads 78 and 80 support the channel sides 14 and 16 at a predetermined spacing that corresponds to the space that is filled by the first pulley block 56. The slots 82 and 84 are positioned for supporting the second pulley block 62 at a predetermined spacing from the bottom 12 of the channel so that both the free end 32 of the extension spring and the first pulley block 56 do not scrub against the channel bottom 12.

Starting at the hook 42 of the spring coupling, the pulley cord 46 is reeved through the two pulley blocks 56 and 62 and is guided by a center portion 86 of the axle 68 between the pulleys 64 and 66 of the second pulley block for exiting the balance. The center portion 86 is preferably formed with shoulders 75 and 77 that maintain a spacing between the pulleys 64 and 66 and with an annular groove 79 that guides the pulley cord 46. A hook 88 attaches the pulley cord 46 to a sash shoe (not shown) for connecting the balance between a window frame and a window sash. A stop 83 is fitted around the pulley cord 46 to hold initial tension of the balance.

Alternatively, the center portion 86 of the axle 68 can be formed as a part of a common journal 90 for supporting three pulleys 92, 94, and 96 as shown in FIG. 7. The center pulley 94 allows the pulley cord 46 to change directions for exiting the balance at the opposite end. This arrangement is especially useful for attaching the pulley cord 46 to a window frame and the channel 10 to a window sash.

We claim:

1. A block and tackle window balance system comprising:

a rigid channel having a bottom, two sides separated at a predetermined spacing, and two ends;

an extension spring having first and second ends;

said first end of the extension spring being attached to one of said two ends of the channel;

first and second blocks of pulleys rotatable about respective first and second axles;

a cord reeved through said first and second blocks of pulleys for attaching the balance system to one of a window sash and a window frame;

a spring coupler for attaching said second end of the extension spring to said first axle;

said first axle including two axle halves extending from opposite sides of said spring coupler;

said pulleys of said first block being mounted on said axle halves;

a plate-shaped head portion of said spring coupler being in engagement with said second end of the extension spring and said head portion being rounded in a plane parallel to said sides of the rigid channel to permit angular movement between said spring coupler and said extension spring toward and away from said bottom of the channel;

said second end of the extension spring being loosely crimped about said head portion of said spring coupler to permit the angular movement between the spring coupler and the extension spring toward and away from said bottom of the channel;

said pulleys of said first block together with said spring coupler being sized in width equal to said predetermined spacing between said two sides of the rigid channel for centering said extension spring within said rigid channel; and said second end of the extension spring being tapered to engage the rounded head portion of the spring coupler as a ball-and-socket joint.

2. The balance system of claim 1 further comprising slots formed in said two sides of the channel at the other of said two ends for receiving said second axle, and said slots having inner ends that restrict movement of said second axle along the length of the channel toward said first block of pulleys.

3. The balance of claim 2 in which two heads are formed at opposite ends of the second axle and said two heads support said two sides of the channel at a predetermined maximum spacing.

4. The balance system of claim 2 in which said second axle includes an annular groove for guiding said cord between pulleys mounted on said second axle.

5. The balance system of claim 2 in which a middle pulley is mounted between two end pulleys on said second axle for reversing a direction at which said cord emerges from the balance system.

* * * * *